United States Patent [19]

Webster

[11] Patent Number: 4,579,357

[45] Date of Patent: Apr. 1, 1986

[54] BOAT-CARRYING AND LAUNCHING DEVICE AND METHOD FOR SAME

[76] Inventor: Charles K. Webster, 348 Haley Rd., Kittery Point, Me. 03905

[21] Appl. No.: 701,543

[22] Filed: Feb. 14, 1985

[51] Int. Cl.[4] ..... B62B 1/10

[52] U.S. Cl. ..... 280/47.13 B; 114/344; 280/47.14

[58] Field of Search ..... 114/52, 123, 344, 347; 280/47.13 B, 414.2, 47.14

[56] References Cited

U.S. PATENT DOCUMENTS

| | | | |
|---|---|---|---|
| 2,361,592 | 10/1944 | Bjork | 114/344 |
| 2,412,162 | 12/1946 | Lindblom | 114/344 |
| 3,004,771 | 10/1961 | Moore, Jr. | 114/344 |
| 3,271,798 | 9/1966 | Zoretic | 114/344 |
| 3,337,243 | 8/1967 | Rued | 280/414.2 |
| 3,603,608 | 9/1971 | Kirkpatrick | 280/47.13 R |
| 3,671,056 | 6/1972 | Windemuth | 280/414.2 X |
| 3,744,072 | 7/1973 | Pannell et al. | 114/344 |
| 4,287,624 | 9/1981 | Lowther | 114/123 X |
| 4,422,665 | 12/1983 | Hinnant | 114/344 X |
| 4,440,409 | 4/1984 | Margison | 280/47.13 B |

*Primary Examiner*—John J. Love
*Assistant Examiner*—Michael Mar
*Attorney, Agent, or Firm*—William Nitkin

[57] ABSTRACT

A device and method to assist in transporting and launching a boat, such device including wheels disposed on a wheel support member beneath the boat when the boat is upside down and a flotation member disposed on such wheel support member positioned under a gunwale of the boat, such method including wheeling the boat on the device while upside down into the water and rotating the boat onto the flotation member to keep the gunwale out of the water and continuing the rotation until the boat is on its bottom floating in the water.

5 Claims, 6 Drawing Figures

BOAT-CARRYING AND LAUNCHING DEVICE AND METHOD FOR SAME

BACKGROUND OF THE INVENTION

1. Field of the Invention

The device and method of this invention reside in the area of boat transporting and launching devices and more particularly relate to a device for supporting the end of a boat such as a canoe and a method for launching the boat upside down by one person without the necessity of inverting the boat before launching.

2. Description of the Prior Art

Many devices have been developed over the years to assist individuals in launching small boats. These devices usually consist of wheels which are affixed to one end of a boat and the user at the other end directs the boat with the wheels rolling on the ground. Such a concept is disclosed in the Boat-wheelbarrow, in U.S. Pat. No. 2,361,592 to Bjork where such a wheel assists in the removal of a boat from a vehicle and allows the user to hold one end of the boat supported on its oars and to roll the boat forward up to the water while the boat is upside down. Another device of this type, described in U.S. Pat. No. 2,412,162 to Lindbloom, incorporates a wheel system under the boat whereby the boat is rolled upside down to the water.

The problem with the prior art is that if the wheel is mounted on top of the boat and the boat is wheeled to the water upside down, the boat must be inverted on land and then either dragged or pushed into the water. This feat can be physically difficult to accomplish. If one positions the wheel(s) on the bottom on the boat, then the boat can be wheeled directly into the water, but one then has the wheel(s) in the water attached to the bottom of the boat. This problem has been addressed in U.S. Pat. No. 4,422,665 to Hinnant where the boat detaches from the wheel structure and in U.S. Pat. No. 3,271,798 to Zopetic where the wheels swing from beneath the canoe up to the top of the canoe.

SUMMARY OF THE INVENTION

It is an object of this invention to provide a new boat-launching device, which, while it can be used on any kind of small boat, is especially advantageous for use on canoes. This device provides, in the manner of the prior art, wheels under the boat while it is pushed upside down toward the water but new to the art is the structure and method of this invention which provides for the boat having a flotation device located on one side of the boat to be wheeled upside down directly into the water. One then rotates the boat onto the flotation device which is then disposed in the water, allowing the boat to be rolled manually over the flotation device until the boat is floating right side up in the water. Once the boat has been launched, the structure of this invention can be easily removed from the boat if desired and folded for storage.

When one wishes to retrieve the boat from the water, one reverses the launching procedure first by reattaching the device of this invention, if previously removed, to the gunwales of the boat. One then rolls the boat back onto the flotation device located on its side thereby supporting the gunwales of the boat out of the water and continues rotating until the boat is upside down and pulls the boat toward shore until the wheels under the boat rest on the bottom of the body of water allowing the boat to be then supported at the other end and easily wheeled out of the water. One can then, by lifting the end not having the device of this invention, roll and maneuver his end of the boat onto the top of the vehicle on which it is to be transported. After the end of the boat not having the device attached is placed on the automobile roof carriers, the rear of the boat with the unit attached is then lifted upwards and pushed forward onto the carriers. One can then remove the wheel unit or leave it in place if desired.

DESCRIPTION OF THE PREFERRED EMBODIMENT(S)

Figure 1:
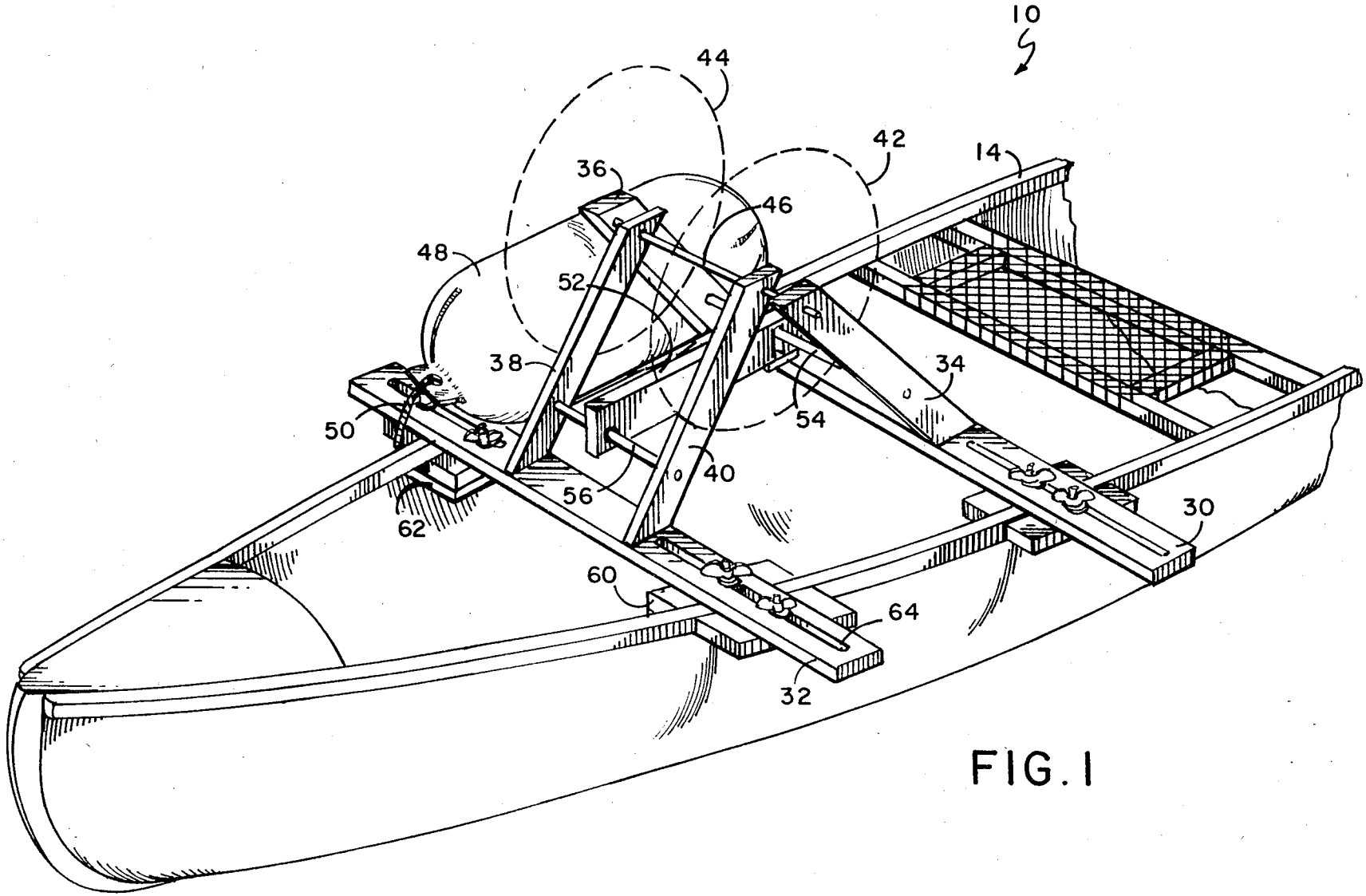
FIG. 1 illustrates a perspective view of the device of this invention mounted on a canoe.

Seen in FIG. 1 is the basic structure of the device of this invention. Although the device is shown attached to a canoe, it can also be used on other types of boats. It should be noted that while the device of this invention can be mounted on the stern of a canoe, mounting it on the bow allows more room for attachment since there is no seat directly under the device. By using the device of this invention, one can launch a small boat or canoe without help or assistance from any other individual. Seen in FIG. 1 is the dolly structure of this invention with first cross member 30 and second cross member 32 extending substantially parallel to each other and affixed across the bow of the canoe and resting on the gunwales of the canoe. For example, the starboard side of first cross member 30 is affixed to starboard gunwale 14 by having an outside block 58 and an inside block 60 adjusted against the gunwale of the canoe. These blocks are maneuverable along the cross member by having a screw with a wing nut passing through the block and through adjustment slot 64 within cross member 30. The wing nuts can be loosened allowing the blocks to be moved with the screw in the slot and when the nut is tightened against the cross member, it holds the blocks in a fixed position. The cross member in another embodiment can be constructed of two pieces where adjustment slot 64 is formed therebetween or in a further embodiment can be formed of one piece with the adjustment slot being cut longitudinally within the cross member as shown. Lower block 62 seen under the inside block of the port side attachment of cross member 30 can be rotated under gunwale 12 as shown and such lower blocks are located at all four contact points of the cross members to the gunwales but are not clearly seen in the drawings as they are behind the device and the starboard side of the canoe. Each contact point of cross members 30 and 32 is affixed securely to the gunwales by such blocks. Outside blocks 58 are slid to a point along adjustment slot 64 where they make tight contact with the gunwales of the canoe, inside blocks 60 are maneuvered over to contact the inside of the gunwales, and lower blocks 62 are rotated under the gunwales. If the canoe is of the type having outside-protruding gunwales, then the inside block can be positioned on the outside and the outside block positioned on the inside so that the lower block rotates under and tightens against the gunwales on the exterior of the canoe. Marks can be provided along the cross members as seen in the drawings so that the blocks can be prepositioned and the cross members consistently centered in their proper positions on the top of the canoe. It can be seen that portions of cross members 30 and 32 extend well beyond the sides of the canoe, and these extension portions will be discussed in further detail below. A wheel support portion is formed by first and second brace members 34 and 36 extending from first cross member 30 upward at an angle to where outer brace members 34 and 36 are interconnected by shaft 46. On this shaft on the inside of each of first and second outer brace members 34 and 36 is positioned pair of wheels 42 and 44. Because the wheels are on the inside of the outer brace members, their rotation is not interfered with by the flotation member. First and second inner brace members 38 and 40 extend at an angle from second cross member 32 and through which inner braces wheel shaft 46 passes. First and second inner braces 38 and 40 are located on the inner side of wheels 42 and 44 which are securely held between the inner and outer brace members at a set distance from the canoe depending upon the angle of the braces to the cross members. The wheels should be of a sufficient diameter to traverse rough terrain easily and should be constructed of a material that will not be affected by water. Generally the further the distance the wheels are apart from one another, the less tippy the boat will be while being wheeled and the further the boat can be rolled into the water. Outer brace shaft 54 can extend between first and second outer brace members 34 and 36 beyond the wheels, and inner brace shaft 56 can extend between inner brace members 38 and 40 also beyond the wheels. Spreader member 52 can be affixed to one of the brace shafts and when the cross members are spread apart, the spreader member can be removably affixed to the other brace shaft. Spreader 52 holds the cross members and brace members rigidly apart from one another so that the device can be positioned on the canoe.

When the device of this invention is not in use and one wishes to put it in its storage mode, one unhooks the block members by loosening the wing nuts above the slots, rotates lower blocks 62 from under the gunwales and lifts the device off the canoe. One then unhooks spreader 52 from one of the brace shafts, allowing the brace members to rotate on wheel shaft 46 so that cross members 30 and 32 come together. The unit can then be easily hung for out-of-the-way storage.

The extensions of first and second cross members 30 and 32 beyond the sides of the canoe are important because it is on these extensions that flotation member 48 is positioned and held in place by elastic cord 50 or by equivalent means. Flotation member's cord 50 is merely slipped onto both extensions of the first and second cross members on one side of the canoe. The first cross member nearest the end of the boat is generally shorter than the second cross member so that the float is positioned parallel to and directly under the gunwale.

Figure 2:
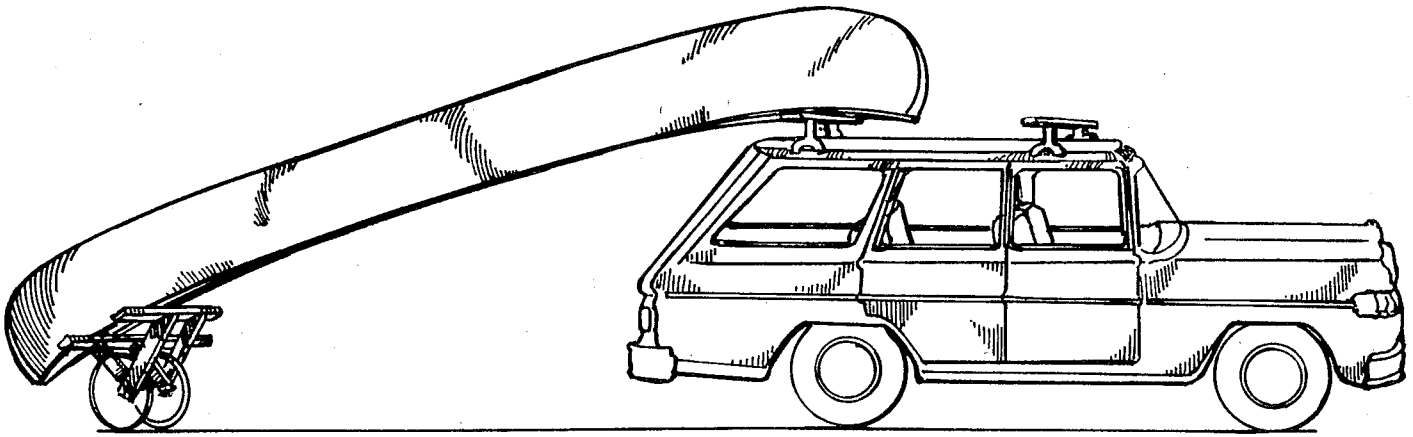
FIG. 2 illustrates a canoe, with the device of this invention mounted thereon, being removed from a vehicle.
Figure 3:
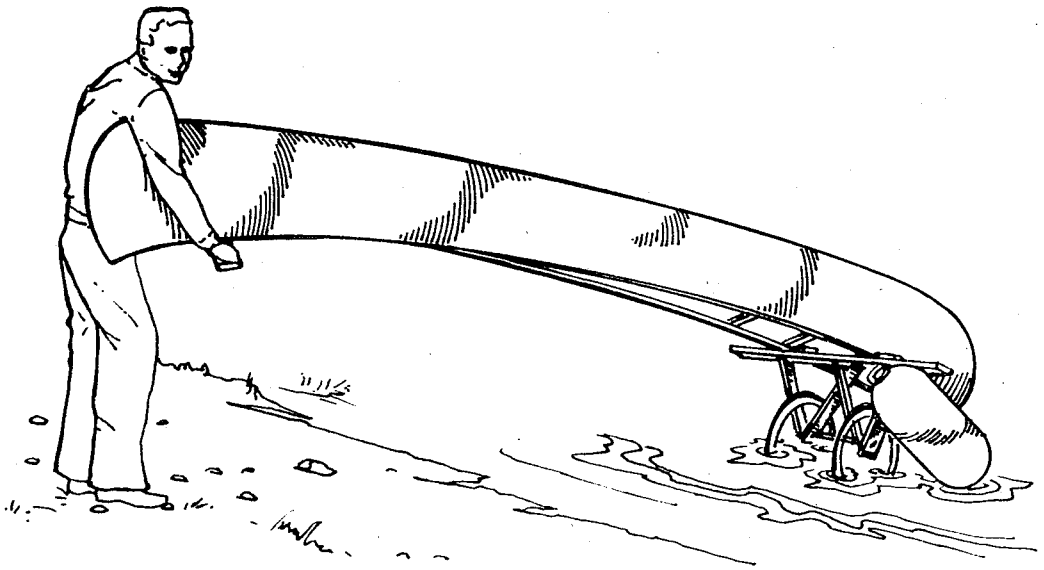
FIG. 3 illustrates a canoe with the device of this invention being rolled into the water by a user.
Figure 4:
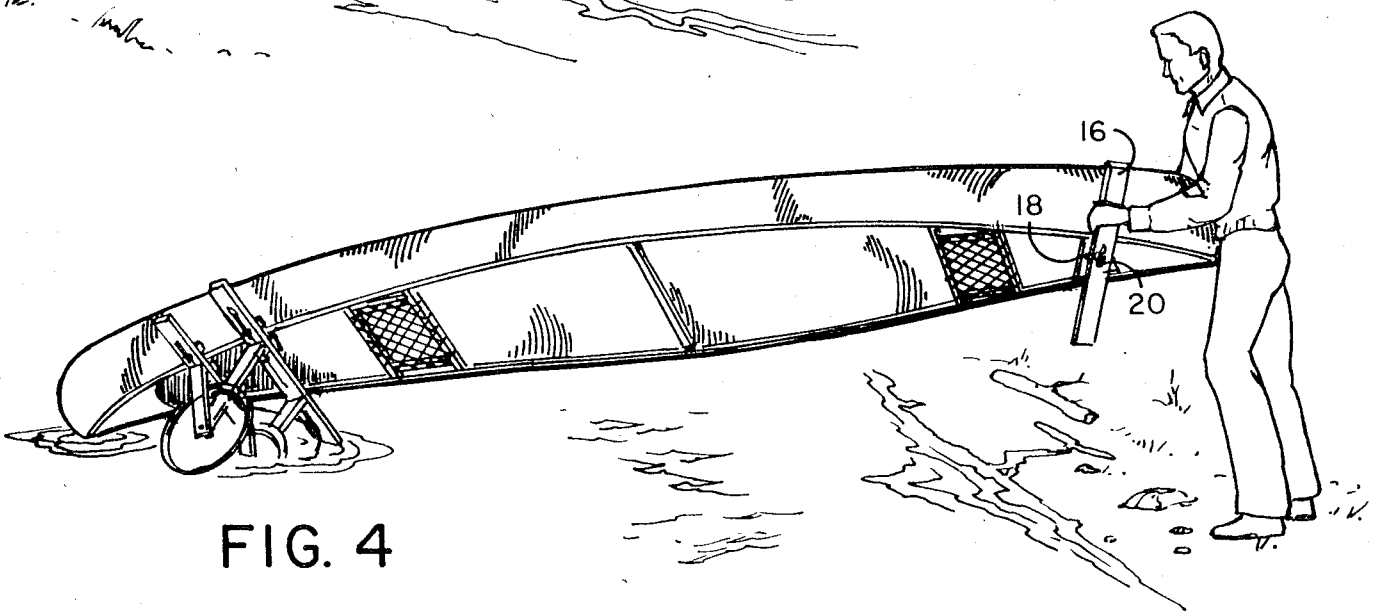
FIG. 4 illustrates a canoe supported by the device of this invention as it is being inverted during launching by the user.
Figures 5, 6:
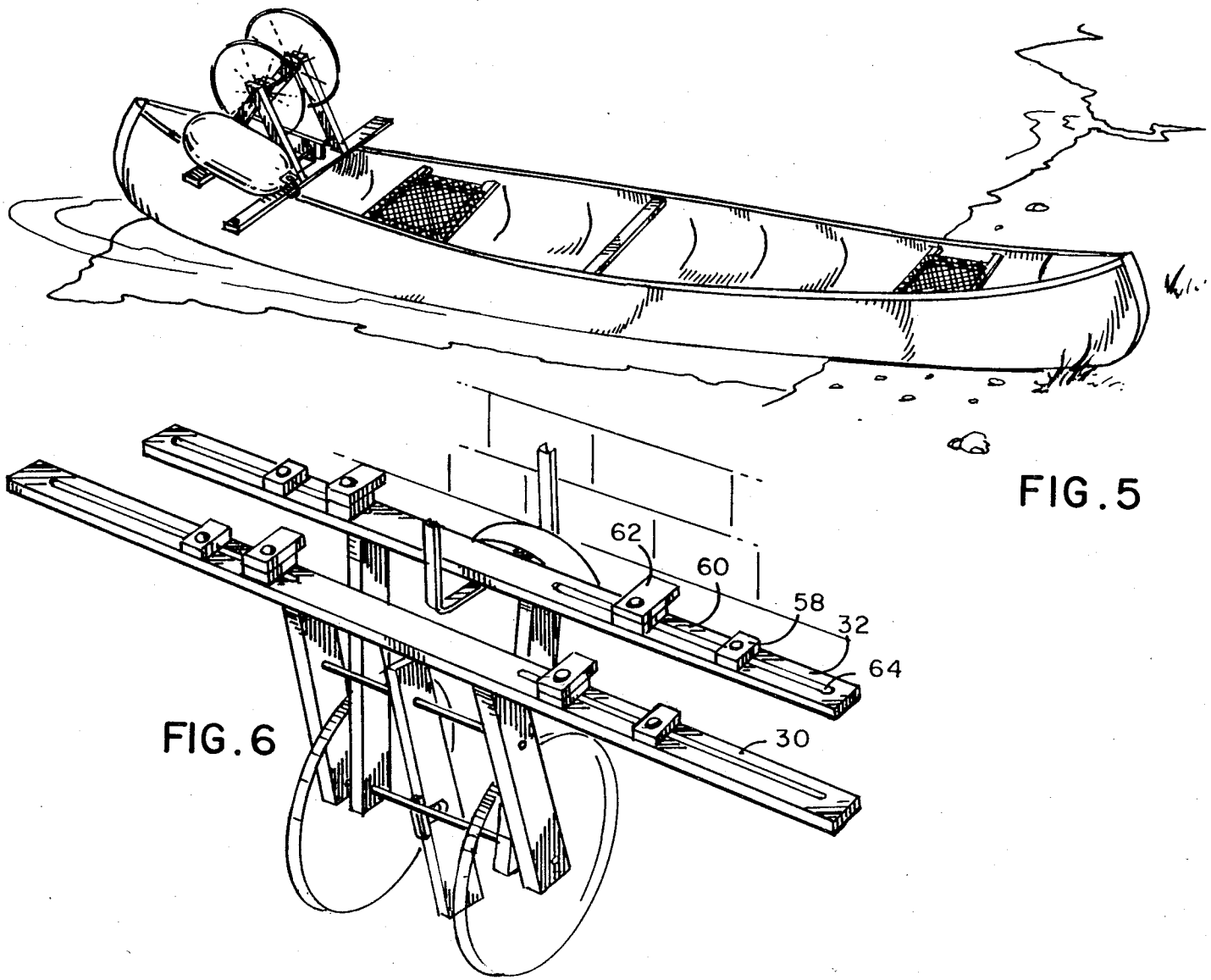
FIG. 5 illustrates a canoe floating in the water with the device of this invention positioned on the gunwales.
FIG. 6 illustrates the device of this invention removed from the canoe and folded for storage.

When one wishes to launch the canoe to which the device of this invention is attached, one removes the canoe from the top of the car by pulling backwards on the canoe and resting the attached wheel members on the ground as seen in FIG. 2. On can then hold the canoe as seen in FIG. 3 at the end opposite the device and wheel the inverted canoe into the water. At this point as seen in FIG. 4, one can rotate the canoe over the flotation member so that the canoe rolls over on its side but will not sink because the flotation member keeps the gunwale of the canoe from dipping into the water and therefore no water enters the canoe. One continues to rotate the canoe onto its bottom as seen in FIG. 5 where the device of this invention is seen attached and extending above the canoe while the canoe floats on the water.

To remove the canoe from the water and position it on a vehicle, one reverses the above-described procedure. One holds the end of the canoe that is on land, rotates the canoe over onto the flotation device and then pulls the canoe toward land until the wheels strike the bottom of the body of water. One can then wheel the canoe out of the water and back to the vehicle where the end of the canoe not having the device is placed up on the rear of the car carriers. One can then go to the rear of the canoe, lift it and push it onto the carriers on top of the vehicle.

In one embodiment, handle 16 located at the other end of the canoe from the device, can be affixed with clamp member 18 attached under the gunwales and tightened by handle-tightening screw 20. This handle assists an individual in holding and maneuvering the canoe and in easily rotating the canoe from one position to another. When the canoe is brought to a storage location and one removes the device as described above, spreader 52 can be detached from one brace shaft when the unit is removed from the canoe and as seen in FIG. 6 the device can be folded and hung on a wall for storage. In some instances the device can be left on the boat for storage thereby supporting one side off the ground. An object can be placed under the other end of the boat to support it off the ground. In some instances the device can be left on the boat for storage thereby supporting one end of the boat off the ground. An object can be placed under the other end of the boat to support that end off the ground.

One can position a second flotation member on the other side of the cross member extensions but such use is not necessary. One should position the flotation member on the side toward which one desires to rotate the canoe but should be careful not to rotate the canoe toward the side without a flotation member as the canoe would take on water and might sink. Such a situation can be remedied by rotating the boat the other way since once the float supports the gunwale, the boat will empty out and then float on its bottom.

Although the present invention has been described with reference to particular embodiments, it will be apparent to those skilled in the art that variations and modifications can be substituted therefor without departing from the principles and spirit of the invention.

I claim:

1. A device for transporting, launching, and retrieving an inverted boat comprising:

at least one wheel;

wheel support means for supporting said wheel above the open top of said boat;

attachment means for releasably attaching said wheel support means to one end of said boat;

means for releasably holding a flotation member on said attachment means adjacent to said wheel support means, said means for holding a flotation member extending beyond a gunwales of said boat; and a flotation member positioned on said means for holding said flotation member at a location outwardly beyond the gunwale of one side of said boat, wherein said flotation member is located below the gunwale of said boat when said boat is in an inverted position for supporting said boat above the water while said boat is being rotated thereover.

2. A device for transporting, launching and retrieving a boat comprising:

a first cross member with at least a portion thereof extending beyond a gunwale of one side of said boat including means to releasably attach first cross member to said gunwale;

a second cross member with at least a portion thereof extending beyond the gunwale of said boat on the same side of said boat as the first cross member extension including means to releasably attach said second cross member to said gunwale;

first and second outer brace members affixed to said first cross member extending upwards therefrom at an angle toward said second cross member;

first and second inner brace members affixed to said second cross member extending upwards therefrom at an angle toward said first cross member;

a shaft member extending through said first and second inner brace members and said first and second outer brace members;

a pair of wheels on said shaft member, the first of which disposed between said first inner brace member and said first outer brace member, and the second of which disposed between said second inner brace member and said second outer brace member;

a flotation member disposed on top of said portions of said first and second cross members that extend beyond said gunwale on at least one side of said boat including means of attachment of said flotation member to said first and second cross members; and said device adapted when rolled into the water and said boat maneuvered on its side having said flotation member be flipped over with said flotation member supporting the gunwale of said boat above the water as said boat rotates.

3. The device of claim 2 further including spreader means to hold said inner brace members and said outer brace members a fixed distance apart from one another.

4. A method of launching and retrieving a boat in a body of water comprising the steps of:

positioning at least one wheel member above the open top of one end of said boat;

supporting said wheel member above said boat by a releasably attachable support means;

providing a flotation member on said support means to one side of said wheel member at a location outwardly beyond the gunwale of said boat, wherein said flotation member is located above the gunwale of said boat when said boat is in an upright position;

wheeling said boat, while in an inverted position, from the shore into the water on said wheel member;

rotating said boat while in an inverted position onto said flotation member;

floating said boat by support of said flotation member for keeping the gunwale out of the water as the boat rotates toward an upright position; and inverting said boat until the bottom of said boat is floating on the water.

5. The method of claim 4 for the launching and retrieval of said boat from the water further including the steps of:

positioning the opposite end of said boat, while in an upright position, on the shore;

rotating said boat onto and over said flotation member;

inverting said boat by said rotation;

pulling said now-inverted boat out of the water;

contacting the bottom of said body of water with said wheel member; and wheeling said inverted boat out of said water onto the shore.

* * * * *